US006771241B2

(12) United States Patent
Miyazawa et al.

(10) Patent No.: US 6,771,241 B2
(45) Date of Patent: Aug. 3, 2004

(54) ACTIVE MATRIX TYPE DISPLAY DEVICE

(75) Inventors: Toshio Miyazawa, Chiba (JP); Tomohiko Sato, Chiba (JP)

(73) Assignee: Hitachi, Ltd., Tokyo (JP)

( * ) Notice: Subject to any disclaimer, the term of this patent is extended or adjusted under 35 U.S.C. 154(b) by 253 days.

(21) Appl. No.: 09/880,819

(22) Filed: Jun. 15, 2001

(65) Prior Publication Data

US 2001/0052890 A1 Dec. 20, 2001

(30) Foreign Application Priority Data

Jun. 16, 2000 (JP) ..... 2000-181692

(51) Int. Cl.[7] ..... G09G 3/34
(52) U.S. Cl. ..... 345/87; 345/89; 345/204
(58) Field of Search ..... 345/89, 204, 87, 345/76, 72

(56) References Cited

U.S. PATENT DOCUMENTS 5,337,070 A 8/1994 Kitajima et al.
5,670,986 A * 9/1997 Leak ..... 345/604
5,712,652 A * 1/1998 Sato et al. ..... 345/90
5,798,746 A 8/1998 Koyama
5,867,137 A * 2/1999 Sugiyama ..... 345/89
5,952,991 A * 9/1999 Akiyama ..... 345/98
5,959,619 A * 9/1999 Kameyama et al. ..... 345/204
6,115,017 A * 9/2000 Mikami et al. ..... 345/92
6,121,952 A * 9/2000 Igari ..... 345/690
6,222,515 B1 * 4/2001 Yamaguchi et al. ..... 345/89

FOREIGN PATENT DOCUMENTS

| | | |
|---|---|---|
| JP | 4-333094 | 11/1992 |
| JP | 05-035200 | 2/1993 |
| JP | 6-102530 | 4/1994 |
| JP | 07-199156 | 8/1995 |
| JP | 8-286170 | 11/1996 |
| JP | 9-113867 | 5/1997 |
| JP | 9-212140 | 8/1997 |
| JP | 1165489 | 3/1999 |
| JP | 1175144 | 3/1999 |

* cited by examiner

*Primary Examiner*—Steven Saras
*Assistant Examiner*—Fritz Alphonse
(74) *Attorney, Agent, or Firm*—Antonelli, Terry, Stout & Kraus, LLP

(57) ABSTRACT

The invention provides an active matrix type display device which realizes an image display of multiple gray scale exhibiting high numerical aperture and high definition with a least number of wiring by having an image memory circuit equivalent to a static memory circuit without using two voltages, that is, high and low voltages. Pixels are arranged at portions where a plurality of scanning lines (selection signal lines) and a plurality of signal lines (data lines (video signal lines)) intersect each other, each pixel is comprised of a pixel electrode, a switching element which selects the pixel electrode and a memory circuit which stores data to be written in the pixel electrode, and a power supply line which applies an AC voltage to the memory circuit is provided.

8 Claims, 12 Drawing Sheets

ACTIVE MATRIX TYPE DISPLAY DEVICE

BACKGROUND OF THE INVENTION

1. Field of the Invention

The present invention relates to an active matrix type display device, and more particularly to a pixel memory system liquid crystal display device and an electroluminescence type display device exhibiting high numerical aperture and high definition.

2. Description of the Related Art

Liquid crystal display devices have been widely adopted as display devices which can perform a color display of high definition for note-type computers and display monitors.

As such liquid crystal display devices, simple matrix type liquid crystal display devices each of which adopts a liquid crystal display element which sandwiches a liquid crystal layer with a pair of substrates which form parallel electrodes arranged in an intersecting manner on respective inner surfaces and active matrix type liquid crystal display devices each of which adopts a liquid crystal display element having switching elements for selecting per pixel on one of a pair of substrates have been known.

A thin film transistor (TFT) type liquid crystal display device which is a typical example of the active matrix type liquid crystal display device applies signal voltages (video signal voltage: gray scale voltage) to a pixel electrode using a thin film transistor TFT provided to each pixel as a switching element and hence, there is no crosstalk between pixels so that the multi-gray scale display having high definition can be realized.

On the other hand, when this type of liquid crystal display device is mounted on an electronic device such as a portable type information terminal or the like which uses a battery as a power source, the reduction of the consumed power which is initiated by the display becomes necessary. To that end, many proposals have been made conventionally with respect to ideas to make each pixel of the liquid crystal display device have a memory function.

FIG. 14 is an explanatory view showing an example of the constitution of one pixel of a liquid crystal display device which makes each pixel have a memory function. FIG. 14 shows a so-called dynamic memory type, wherein a memory capacitor is provided to an output side (pixel electrode side) of a thin film transistor TFT mounted on a point of intersection between a signal line and a scanning line and display data is held for a given time after inputting the display data into the memory capacitor. In the drawing LC indicates a liquid crystal capacitor.

This dynamic memory type has to be refreshed periodically since the data held in the memory capacity leaks as time elapses. Particularly, when the memory function of the pixel is constituted using the polycrystalline silicon semiconductor, there is a tendency that the leak current is increased. Accordingly, it is necessary to shorten the refreshing cycle.

However, when the refreshing cycle is shortened, it brings about a drawback that an advantageous effect that the unnecessary writing can be omitted by giving the memory function to each pixel so that peripheral circuits and the power consumption can be reduced is decreased.

To solve the above-mentioned drawback, an active matrix type display device which adopts a static memory type in place of the dynamic memory type has been proposed.

FIG. 15 is an essential part circuit diagram for explaining an example of memory circuit of a static memory type described in FIG. 3 of Japanese Laid-open Patent Publication 333094/1992. In the drawing, a portion surrounded by a chained line indicates a pixel memory. This circuit is comprised of a NMOS transistor 111, a PMOS transistor 112 and inverters 121, 122. Scanning signals Vg are supplied to gates of the NMOS transistor 111 and the PMOS transistor 112, while gray scale signals (brightness signals) Vd are supplied to a drain of the NMOS transistor 111. A source of the NMOS transistor 111 is connected to an input of the inverter 122 together with a source of the PMOS transistor 112.

An output DM of the memory circuit which selects the liquid crystal drive voltage is taken out from an output of the inverter 122. The inverter 121 receives this signal DM as an input and an output of the inverter 121 is connected to a drain of the PMOS transistor 112.

The NMOS transistor 111 takes the "OFF" state when the scanning signal Vg is set to "0" and becomes the "ON" state when the scanning signal Vg is set to "1". To the contrary, the PMOS transistor 112 becomes the "OFF" state when the scanning signal Vg is set to "1" and becomes the "ON" state when the scanning signal Vg is set to "0". Accordingly, the memory circuit interrupts the brightness signal Vd when the scanning signal Vg is set to "0" and connects the output of the inverter 121 to the input of the inverter 122 so that data storage state is obtained. Further, when the scanning signal Vg is set to "1", the memory circuit connects the brightness signal Vd to the input of the inverter 122 so as to obtain the data passing state.

FIG. 16 is an essential part circuit diagram for explaining another example of a memory circuit of a static memory type described in FIG. 2(*b*) of Japanese Laid-open Patent Publication 194205/1996. In the drawings, a portion surrounded by a chained line indicates a pixel memory. This circuit is comprised of switching elements 21, 22, 23 and 24 which are formed of thin film transistors arranged at intersecting portions between scanning lines 3 and signal lines 4. The switching elements 22, 23 constitute an inverter and forms a memory circuit. A scanning voltage (pulse) is applied to the scanning line 3 and, in synchronism with this step, a signal which controls the opening/closing of the switching element 24 is inputted to the switching element 21 though the signal line 4.

As other prior art which provides a memory to each pixel, there have been known techniques disclosed in Japanese Laid-open Patent Publication 102530/1994, Japanese Laid-open Patent Publication 286170/1996, Japanese Laid-open Patent Publication 113867/1997, Japanese Laid-open Patent Publication 212140/1997, Japanese Laid-open Patent Publication 65489/1997 and Japanese Laid-open Patent Publication 75144/1999.

However, in any one of these prior arts, a DC voltage whose voltage level is not changed is applied to a power supply node of a memory circuit of each pixel every hour and hence, a technical concept to apply an AC voltage whose voltage level is changed along with the lapse of time to a power supply node of a memory circuit has been neither disclosed nor suggested in these prior arts.

Accordingly, in any one of these prior arts, it is necessary to particularly provide wiring for supplying a DC current for each pixel to maintain the storage of memory of each pixel.

In the above-mentioned conventional constitution, since the liquid crystal display device adopts the static memory type, it is necessary to supply two fixed voltages to each pixel, that is, high and low voltages which are originally unnecessary in a pixel array portion of the liquid crystal display device and hence, particular wiring for such fixed voltages becomes necessary and this leads to the lowering of the numerical aperture particularly in the transmission type liquid crystal display device.

Further, not to mention with respect to the transmission type liquid crystal display device, even in the reflection type liquid crystal display device and the electroluminescence display device, wiring of peripheral circuits such as drivers which drive pixels becomes large in number so that the peripheral region of the display device becomes large thus interrupting the miniaturization of the liquid crystal display device.

SUMMARY OF THE INVENTION

Accordingly, it is an object of the invention to provide an active matrix type display device which can solve the above-mentioned various problems of the prior art and can realize a multiple-gray scale image display exhibiting high numerical aperture, high definition and the least number of wiring which has an image memory circuit equivalent to a static memory circuit without using two fixed voltages, that is, high and low fixed voltages which are originally unnecessary in a pixel array portion of the liquid crystal display device.

To achieve the above-mentioned object, according to the invention, the data holding of the image memory is performed by a circuit constitution which uses pixel drive pulses, for example, liquid crystal AC drive pulses with respect to liquid crystals as a power supply.

That is, according to the first aspect of the invention, pixels are arranged at portions where a plurality of scanning lines and a plurality of signal lines intersect each other, each pixel is comprised of a pixel electrode, a switching element which selects the pixel electrode and a memory circuit which stores data to be written in the pixel electrode, and a power supply line which applies an AC voltage to the memory circuit is provided to the memory circuit.

According to a second aspect of the invention, an active matrix type display device includes a plurality of pixels which are arranged in the row direction and the column direction and a plurality of scanning lines and a plurality of signal lines which are provided corresponding to respective pixels and are extended in the row direction, and each pixel is comprised of a pixel electrode, a switching element which selects the pixel electrode, a memory circuit which stores display data of the pixel electrode, and selection circuit which selects a voltage applied to the pixel electrode and supplies one of the selected electrodes to the memory circuit.

According to the third aspect of the invention, one pixel (unit pixel) is constituted by collecting a plurality of element pixels (cells), the unit pixels in a plural number are arranged in the row direction and in the column direction, a plurality of row selection lines which are extended in the row direction and a plurality of column selection lines which are extended in the column direction are provided corresponding to the element pixels, each element pixel includes a pixel electrode, a switching circuit which selects the pixel electrode, a memory circuit which stores the turn-on/turn-off of the pixel electrode, and a selection circuit which selects a voltage applied to the pixel electrode, and a row selection circuit which drives a plurality of row selection lines and a column selection circuit which drives a plurality of column selection lines by supplying one of voltages applied to the pixel electrodes to the memory circuit, and a plurality of element pixels which belong to one unit pixel are simultaneously selected through the row selection circuit and the column selection circuit.

According to the fourth aspect of the invention, the gray scale is displayed by controlling the number of element pixels in the turn-on state out of a plurality of element pixels which belong to one unit pixel based on data written in the memory circuit.

According to the fifth aspect of the invention, the gray scale is displayed by controlling the rate between the turn-on period and the turn-off period of the element pixels which belong to one unit pixel based on data to be written in the memory circuit.

Due to such constitutions, the number of wiring can be decreased thus preventing the lowering of the numerical aperture of the pixels whereby the image display of a multiple gray scales and high definition can be realized.

The invention is not limited to the above-mentioned constitution and the constitutions of embodiments which will be explained later and various modifications are considered without departing from the technical concept of the invention.

DESCRIPTION OF THE PREFERRED EMBODIMENTS

Modes for carrying out the invention are explained in detail hereinafter in conjunction with attached drawings which show embodiments.

Figure 1:
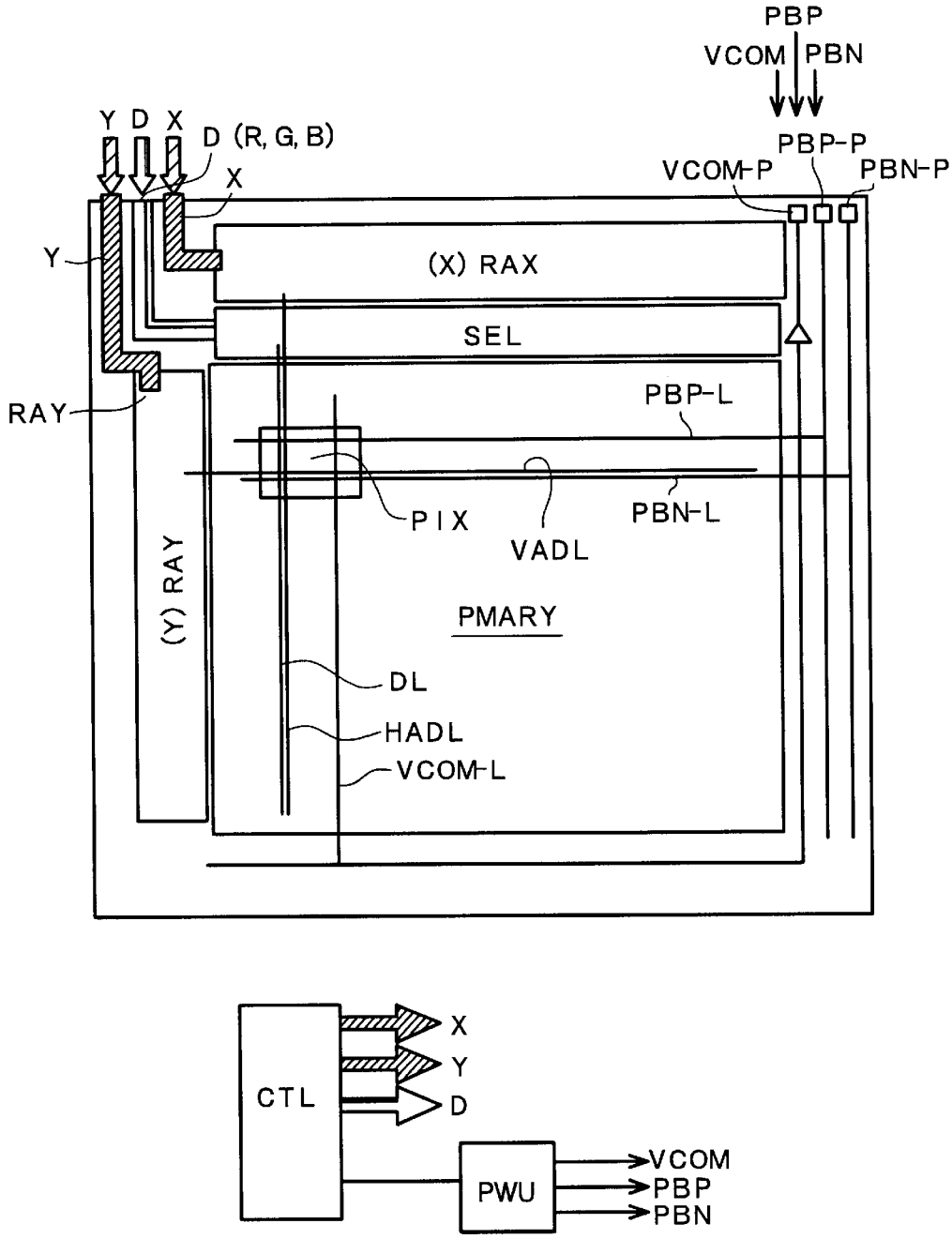
FIG. 1 is a schematic view for explaining a general constitution of a liquid crystal display device according to the invention.

FIG. 1 is a schematic view for explaining a general constitution of an active matrix type display device, more specifically to a liquid crystal display device according to the invention. In this active matrix type display device, a random access circuit (X) RAX in the X direction is disposed at one side of a pixel memory array PMARY which is constituted of a plurality of pixels PIX on a substrate which are arranged on an X-Y plane in a two-dimensional manner and a random access circuit (Y) RAY in the Y direction is disposed at the other side of the pixel memory array. Further, a selection switch array SEL is provided to the random access circuit (X) RAX side.

Selection signal lines HADL delivered from the random access circuit (X) RAX are wired on the pixel memory array and selection signal lines VADL delivered from the random access circuit (Y) RAY are wired on the pixel memory array. Further, data lines (video signal lines) DL delivered from the selection switch array SEL are wired over the pixel memory array. The pixels PIX are formed on the intersecting portions of the selection signal lines HADL, the selection signal lines VADL and the data lines DL. A common wiring VCOM-L which applies a fixed voltage (common electrode voltage) VCOM is wired to the pixel PIX.

On still another side of the pixel memory array, an applying pad VCOM-P of the fixed voltage VCOM is mounted.

Then, on the side on which the applying pad VCOM-P of the fixed voltage VCOM is mounted, applying pads PBP-P and PBN-P for two kinds of voltages PBP and PBN which differ every field are mounted and alternating voltage lines PBP-L and PBN-L which are connected to these applying pads PBP-P and PBN-P are extended toward the pixel PIX.

X address data X, Y address data Y and digital data (R, G, B) constituting display signals which are outputted from a display control device CTL are respectively supplied to the random access circuit (X) RAX, the random access circuit (Y)RAY and a digital data bus line D through respective bus lines X, Y and D.

The fixed voltage VCOM and the alternating voltage PBP and PBN are supplied from a power supply circuit PWU which is controlled by the display control device CTL.

Figure 2:
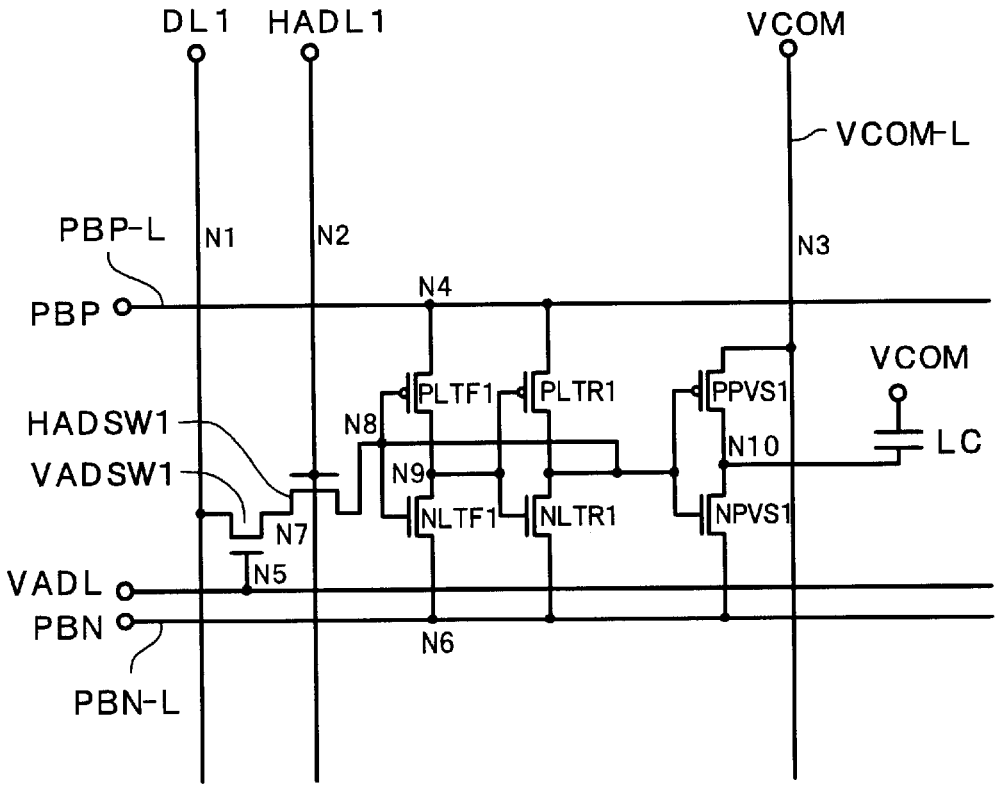
FIG. 2 is a circuit block diagram for explaining a constitution of one pixel of one embodiment of the invention.

FIG. 2 is a circuit block diagram for explaining the constitution of one pixel of the liquid crystal display device of the first embodiment of the invention. In one of the substrates which sandwich a liquid crystal LC, a video signal line DL1 which forms a video signal line DL constitutes a wiring which supplies video signals to the pixel and selection signal lines HADL 1 and VADL constitutes wiring for selecting the pixel to which the video signals are applied. The pixel has a function of holding the applied video signal until the pixel is selected and written next time.

In this embodiment, by replacing the liquid crystal LC with an electroluminescence element, the active matrix type display device is changed to an electroluminescence type display device.

The fixed voltage VCOM is applied to the fixed voltage line VCOM-L. Further, the fixed voltage VCOM is also applied to an electrode formed on the other substrate out of the substrates which sandwich the liquid crystal LC. The alternating voltages PBP and PBN are applied to the alternating voltage lines PBP-L and PBN-L.

Writing of the video signals to the pixel is performed when two NMOS transistors VADSW1 and HADSW1 become the "ON" state with respective selection signals applied to the selection signal line HADL1 which constitutes the selection signal line HADL 1 and the selection signal line VADL.

A first inverter is constituted such that the written video signal potential is used as an input gate (voltage node N8) potential and an output part (voltage node N9) is formed by electrically connecting electrodes or diffusion regions which constitute respective sources or drains of a pair of p-type electric field effect transistor PLTF1 and an n-type electric field effect transistor NLTF1. Hereinafter, the voltage nodes are simply called "node".

A second inverter is constituted of a pair of p-type electric field effect transistor PLTR1 and n-type electric field effect transistor NLTR1 which use the potential of the output part (node N9) where the electrodes or diffusion regions which constitute respective sources or drains of a pair of p-type electric field effect transistor PLTF1 and n-type electric field effect transistor NLTF1 which constitute the first inverter are electrically connected as an input gate potential.

A third inverter is constituted of a pair of p-type electric field effect transistor PPVS1 and n-type electric field effect transistor NPVS1 which use the potential of the output part (node N8) where the electrodes or diffusion regions which constitute respective sources or drains of a pair of p-type electric field effect transistor PLTR1 and n-type electric field effect transistor NLTR1 which constitute the second inverter are electrically connected as an input gate potential.

Then, the output portions (nodes N8) of a pair of p-type electric field effect transistor PLTR1 and n-type electric field effect transistor NLTR1 which constitute the second inverter are simultaneously electrically connected to the input gate (node N8) of the first inverter.

In the n-type electric field effect transistors NLTF1 and NLTR1 which constitute the first and second inverters, the sources, the drains or the diffusion areas (node N6) thereof which are not outputs of the inverters are connected to one of a pair of alternating voltage lines (PBN).

Further, in the p-type electric field effect transistors PLTF1 and PLTR1 which constitute the first and second inverters, sources, drains or diffusion areas (node N4) thereof which are not outputs of the inverters are connected to an alternating voltage line PBP of a voltage which forms a pair with the alternating voltage line (node N6) to which electrodes constituting the sources, the drains or the diffusion areas which are not outputs of the inverters of the n-type electric field effect transistors of the first and second inverters are connected.

One (node N6) of electrodes (node N6 and N10) and diffusion regions which form respective sources or drains which are not inverter output portions (node N10) of a pair of p-type electric field effect transistor PPVS1 and n-type electric field effect transistor NPVS1 which constitute the third inverter are connected to any one (PBN) of the above-mentioned alternating voltage lines and the other is connected to the fixed voltage line VCOM.

Figure 3:
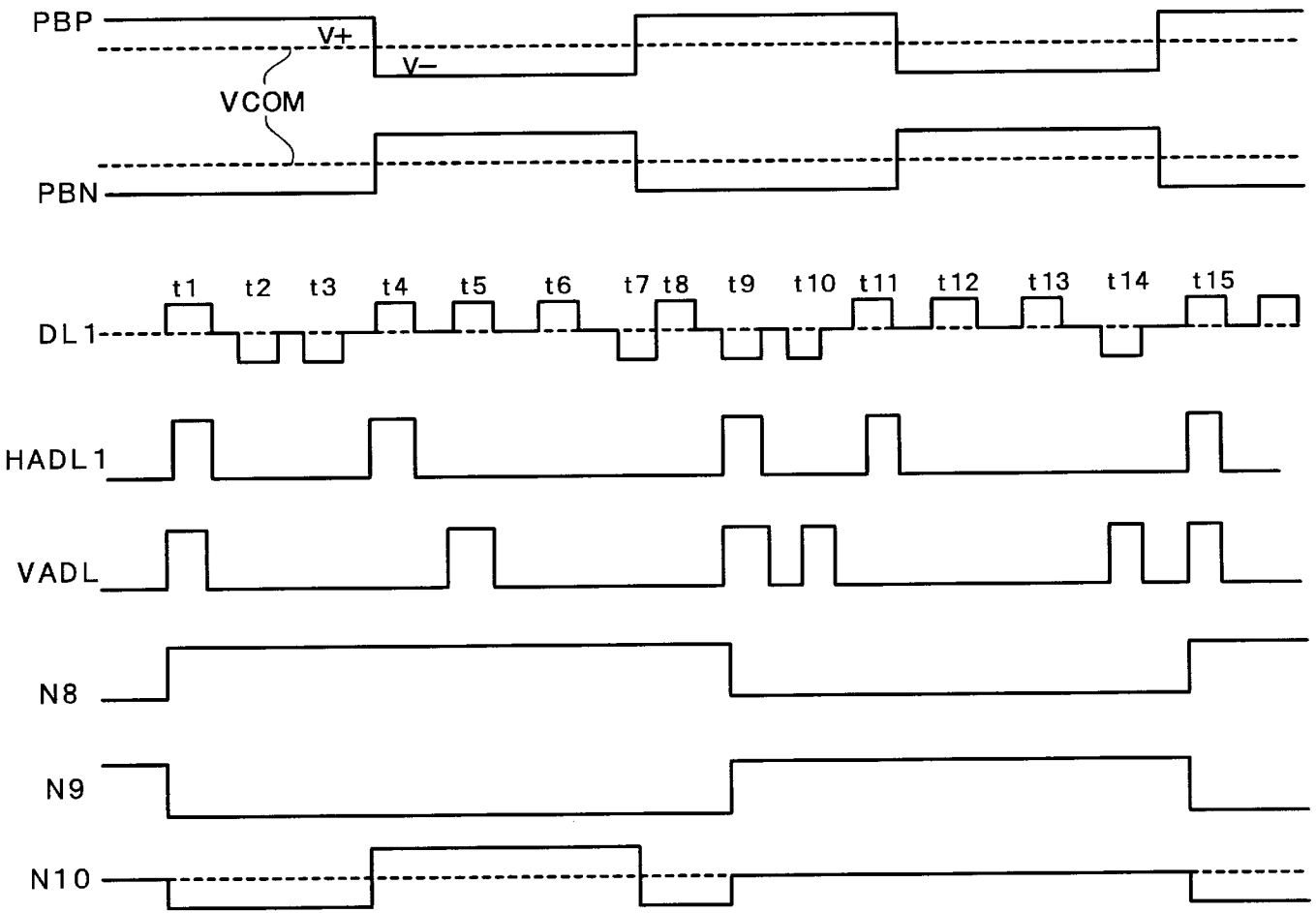
FIG. 3 is a wave form chart for explaining the operation of a pixel circuit shown in FIG. 2.

FIG. 3 is a waveform diagram for explaining the operation of a pixel circuit shown in FIG. 2, wherein the pulse voltage applied to respective signal lines and the node voltage are shown while taking time on axis of coordinates time. In the drawing, DL1 shows an example of signal pulses applied to the video signal line (drain line) common to pixel rows (or pixel column) in the pixel array (pixel memory array) containing the pixels.

In this embodiment, when the selection signal lines HADL1 and VADL1 simultaneously become the "High" state, two transistors VADSW1 and HADSW1 become the "ON" state. The voltage level of the video signal lines (drain lines) DL1 at this point of time are written in the node N8 of the pixel memory.

In FIG. 3, (1) at the timing t1, the NMOS transistors of the transistors VADSW1 and HADSW1 become the "ON" state and the voltage level of the video signal line DL at this point of time is written in the node N8 of the pixel memory.

(2) Assume that the state of the node N8 before the timing t1 is low (Low), the state of the node N8 is changed from the "Low" state to the "High" state due to this writing. Here, in the example shown in FIG. 3, the voltage states of a pair of alternating voltage lines PBP, PBN are set such that the voltage state of the alternating voltage line PBP is high (+V) and the voltage state of the alternating voltage line PBN is low (−V). Accordingly, the voltage applying conditions of the p-type field effect transistor PLTF1 and the n-type field effect transistor NLTF1 as well as the p-type field effect transistor PLTR1 and the n-type field effect transistor NLTR1 of two inverters are in the normal operation state so that the node N8 becomes the "High" state. Then, the p-type field effect transistor PLTF1 becomes the "OFF" state and the n-type field effect transistor NLTF1 becomes the "ON" state and the output node N9 is connected to the alternating voltage line PBN. That is, the state is changed from the "High" state to the "Low" state.

Due to the change of the state of node N9 from the "High" state to the "Low" state, out of the p-type field effect transistor PLTR1 and the n-type field effect transistor NLTR1, the p-type field effect transistor PLTR1 becomes the "ON" state and the n-type field effect transistor NLTR1 becomes the "OFF" state and hence, the output node N8 is connected to the alternating voltage line PBP and the state of the output node N8 becomes the "High" state. As a result, at the same timing, the NMOS transistors VADSW1 and HADSW1 become the "OFF" state and even after the node N8 is electrically cut from the video signal line DL1, the node N8 is connected to an external potential in the written state ("High" state) at the timing t1and can hold this state (having a memory function).

(3) The voltage of the node N8 is simultaneously the gate voltages of a pair of p-type field effect transistor PPVS1 and n-type field effect transistor NPVS1 which constitute the third inverter. Since the node N8 is in the "High" state, the p-type field effect transistor PPVS1 and the n-type field effect transistor NPVS1 which constitute the third inverter respectively become the "OFF" state and the "ON" state so that the pixel electrode not shown in the drawing which drives the liquid crystal LC is connected to the alternating voltage line PBP.

Since the potential of the alternating voltage line PBN is at the Low (−V) state during the period from the timing t1 to the timing t3, the pixel electrode becomes the Low (−V) state and the state in which a voltage equal to the voltage difference relative to the potential of the counter electrode VCOM (−((+V) +(−V))/2) is applied to the liquid crystal is established.

(4) Since the potentials of a pair of alternating voltage lines PBP, PBN are not fluctuated during the period from the timing t1 to the timing t3, the above-mentioned states (2) and (3) are held.

(5) At the timing t4, a pair of alternating voltage lines PBP, PBN inverts their potentials. That is, the alternating voltage line PBP is changed from the "High" state (+V) to the "Low" state (−V) and the alternating voltage line PBN is changed from the "Low" state (−V) to the "High" state (+V).

(6) The operation of the pixel memory at this point of time is as follows. Since the node N8 is in the "High" state, with respect to a pair of p-type field effect transistor PLTF1 and n-type field effect transistor NLTF1 which constitute the first inverter, the n-type field effect transistor NLTF1 is still in the "ON" state and the output node N9 thereof is electrically connected to the alternating voltage line PBN.

Accordingly, along with the change of the potential of the alternating voltage line PBN from the "Low" state (−V) to the "High" state (+V), the node N9 is also changed from the "Low" state (−V) to the "High" state (+V).

(7) When the node N9 becomes the "High" state (+V), with respect to the p-type field effect transistor PLTR1 and the n-type field effect transistor NLTR1 which constitute the second inverter, the p-type field effect transistor PLTR1 becomes the "OFF" state and the n-type field effect transistor NLTR1 becomes the "ON" state. Due to such changes, the output node N8 is connected to the alternating voltage line PBN through the n-type field effect transistor NLTR1. Accordingly, the potential of the output node N8 becomes the "High" state (+V) and, in this case also, the bias is applied to hold the node N8 in the "High" state (+V) and hence, with respect to a pair of p-type field effect transistor PPVS1 and n-type field effect transistor NPVS1 which constitute the third inverter, the p-type field effect transistor PPVS1 maintains the "OFF" state and the n-type field effect transistor NPVS1 maintains the "ON" state.

In this case also, although the pixel electrode (not shown in the drawing) which drives the liquid crystal LC is connected to the alternating voltage line PBN, since the potential of the alternating voltage line PBN is in the "High" state (+V), the potential of the pixel electrode becomes the "High" state (+V). In this case also, the state in which a voltage equal to the voltage difference relative to the potential of the counter electrode VCOM (−((+V)+(−V))/2) is applied to the liquid crystal is established.

Contrary to the above-mentioned case (3), the sign of voltage to the counter electrode potential VCOM at this point of time becomes inverse. This is exactly an alternating voltage applying method which is generally used to prevent the deterioration of the liquid crystal at the time of driving the liquid crystal and hence matches the drive method which the pixel memory realizes.

(8) In FIG. 3, a pair of alternating voltage lines PBP, PBN again invert the potentials at the timing t7. That is, the alternating voltage line PBP is changed from the "Low" state (−V) to the "High" state (+V), while the alternating voltage line PBN is changed from the "High" state (+V) to the "Low" state (−V). In this case, the above-mentioned states explained with respect to steps (2) and (3) are repeated.

(9) In FIG. 3, the NMOS transistors VADSW1 and HADSW1 again become the "ON" state at the timing t9 and the node N8 is connected to the video signal line DL1. The state of the video signal line DL1 at this point of time is in the "Low" state (−V). Accordingly, the node N8 is changed to the "Low" state (−V) and, out of a pair of p-type field effect transistor PLTF1 and n-type field effect transistor NLTF1 which constitute the first inverter, the p-type field effect transistor PLTF1 is changed to the "ON" state and the n-type field effect transistor NLTF1 is changed to the "OFF" state.

At this point of time, since the alternating voltage line PBP is in the "High" state (+V) and the alternating voltage line PBN is in the "Low" state (−V), the output nodes N9 of a pair of p-type field effect transistor PLTF1 and n-type field effect transistor NLTF1 are connected to the alternating voltage line PBP and become the "High" state (+V).

Since the node N9 is in the "High" state (+V), out of a pair of p-type field effect transistor PLTR1 and n-type field effect transistor NLTR1 which constitute the second inverter, the transistor PLTR1 is changed to the "OFF" state and the transistor NLTR1 is changed to the "ON" state. The output node NB is electrically connected to the alternating voltage line PBN.

Since the alternating voltage line PBN is in the "Low" state (−V), the node N8 becomes the "Low" state (−V) and maintains the "Low" state (-V) even after the NMOS transistors VADSW1 and HADSW1 again become the "OFF" state.

(10) Since the node N8 is in the "Low" state (−V), out of a pair of p-type field effect transistor PPVS1 and n-type field effect transistor NPVS1 which constitute the third inverter, the transistor PPVS1 becomes the "ON" state and the transistor NPVS1 becomes the "OFF" state and hence, the pixel electrode (not shown in the drawing) which drives the liquid crystal LC is connected to the counter electrode potential VCOM. The pixel electrode becomes the voltage VCOM and has the potential equal to the counter electrode potential VCOM and hence, the state that the voltage is not applied to the liquid crystal is established.

(11) At the timing t12, a pair of alternating voltage lines PBP and PBN again invert the potentials thereof. That is, the alternating voltage line PBP is changed from the "High" state (+V) to the "Low" state (−V) and the alternating voltage line PBN is changed from the "Low" state (−V) to the "High" state (+V). Since the node N8 remains in the "Low" state (−V), out of a pair of p-type field effect transistor PLTF1 and n-type field effect transistor NLTF1 which constitutes the first inverter, the transistor PLTF1 remains in the "ON" state and the transistor NLTF1 remains in the "OFF" state, that is, in the "Low" state (−V).

When the node N9 is changed to the "Low" state (−V), out of a pair of p-type field effect transistor PLTR1 and n-type field effect transistor NLTR1 which constitute the second inverter, the transistor PLTR1 is changed to the "ON" state and the transistor NLTR1 is changed to the "OFF" state. The output node N8 is electrically connected to the alternating voltage line PBP. Since the alternating voltage line PBP is in the "Low" state (−V), the node N8 becomes the "Low" state (−V) and holds the "Low" state (−V).

(12) Since the node N8 is in the "Low" state (−V), out of a pair of p-type field effect transistor PPVS1 and n-type field effect transistor NPVS1 which constitute the third inverter, the transistor PPVS1 becomes the "ON" state and the transistor NPVS1 becomes the "OFF" state and hence, the pixel electrode (not shown in the drawing) which drives the liquid crystal LC is connected to the counter electrode potential VCOM. The pixel electrode becomes the voltage VCOM and has the potential equal to the counter electrode potential VCOM and hence, the state that the voltage is not applied to the liquid crystal is established.

(13) Due to the constitution described heretofore, using the alternating voltages which are originally applied to respective electrodes for preventing the deterioration of the liquid crystal, the state of the memory (latch memory) formed in the pixel can be held.

(14) In the above-mentioned steps (6) and (11), as a premise, even when the potential of the alternating voltage is changed, the potential of the node N8 is not changed. However, in an actual circuit designing, the potential of the node N8 is a factor which changes. In an extreme case, for example, in a case that the capacity of the node N9 is designed to become extremely large compared to the node N8, since the potential of the node N9 is hardly changed, in a closed latch-up memory (circuit constitution in which the first inverter which is constituted of a pair of p-type field effect transistor PLTF1 and n-type field effect transistor NLTF1 and the second inverter which is constituted of a pair of p-type field effect transistor PLTR1 and n-type field effect transistor NLTR1 make respective outputs thereof become inputs to counterpart inverters) which starts its change toward the self stabilization, the self-stabilized state is controlled by the potential of the node N9. That is, assuming that the above-mentioned step (6) is the case in which node (9) controls, since the node N9 is in the "Low" state (−V), the transistor PLTR1 of the second inverter becomes the "ON" state (+V) and the n-type field effect transistor NLTR1 of the second inverter becomes the "OFF" state (−V). Accordingly, the node N8 is connected to the alternating voltage line PBP and, under the condition of the step (6), the alternating voltage line PBP is in the "Low" state (−V) and hence, the node N8 is changed from the "High" state (+V) to the "Low" state (−V) so that the holding of the memory is stopped.

Figure 5:
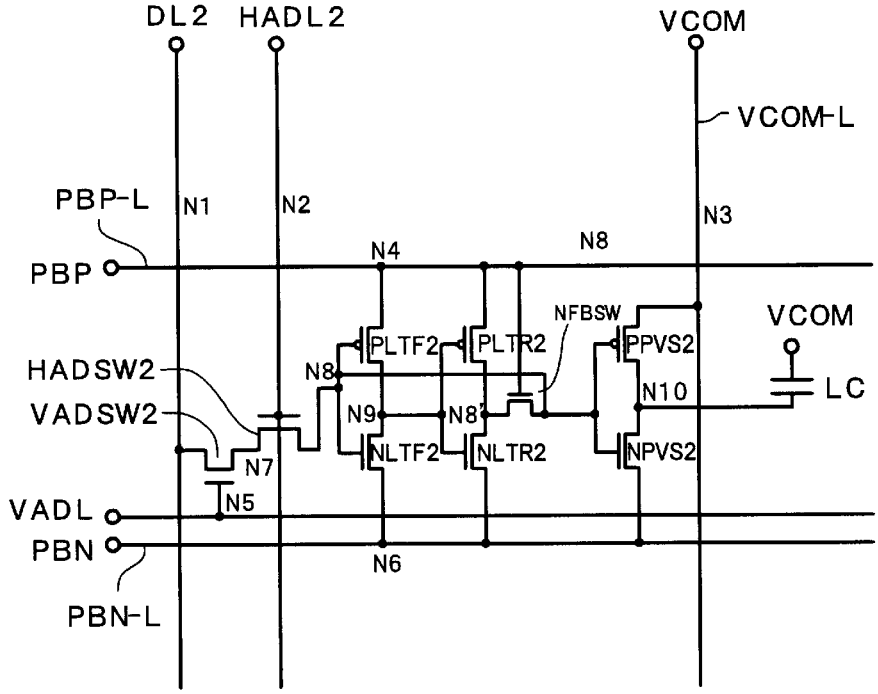
FIG. 5 is a circuit block diagram for explaining a constitution of one pixel of the third embodiment of the invention.
Figure 6:
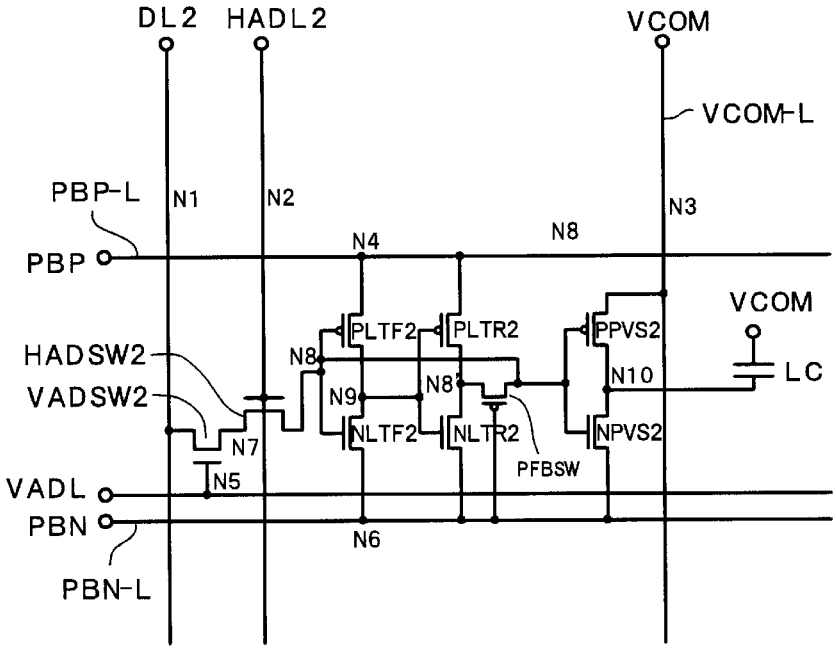
FIG. 6 is a circuit block diagram for explaining a constitution of one pixel of the fourth embodiment of the invention.

(15) To consider the node N8 and the node N9 in view of FIG. 2, the node N9 has only the gate capacity and the self wiring capacity of the transistors PLTR1 and NLTR1 of the second inverter. To the contrary, the node N8 has not only the gate capacity and the self wiring capacity of the transistors PLTF1 and NLTF1 of the first inverter but also the gate capacity of the transistors PPVS1 and NPVS1 of the third inverter and the gate capacity and coupling capacity of the NMOS transistor HADSW1 and hence, it is generally considered that node N8 controls the self stability state. However, depending on the designing, there is a possibility that the situation in the above-mentioned step (14) arises. A circuit constitution which takes the above into account is shown in FIG. 4 to FIG. 6.

Figure 4:
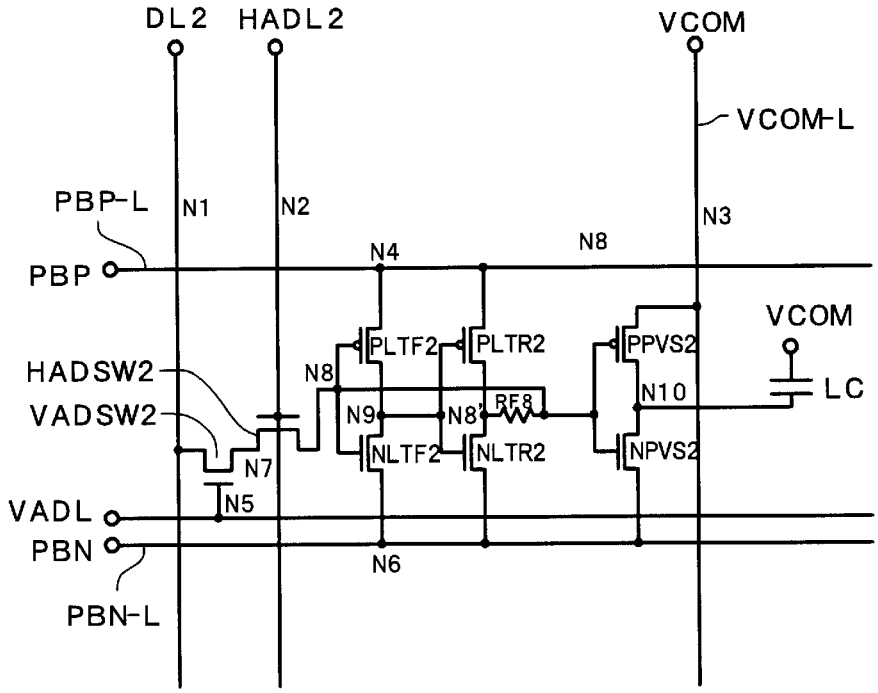
FIG. 4 is a circuit block diagram for explaining a constitution of one pixel of the second embodiment of the invention.

FIG. 4 is a circuit diagram for explaining the constitution of one pixel of the second embodiment of the invention. Symbols which are equal to the symbols in FIG. 2 indicate functional portions identical with those in FIG. 2 (Numeral 2 in symbols corresponds to elements or lines identical with those which are affixed with numeral 1 in FIG. 2).

In the embodiment, between an input node N8 of a p-type field effect transistor PLTR1 and an n-type field effect transistor NLTR1 which constitute a second inverter and an output node N8' of a p-type field effect transistor PLTF1 and an n-type field effect transistor NLTF1 which constitute a first inverter, a resistor RFB is inserted.

The memory state of the node N8 is the potential fluctuation derived mainly from the leak at the "OFF" level of the NMOS transistors VADSW2 and the HADSW2 and the capacity coupling with other wiring (DL2, PBP, PBN, VADL, HADL2) and it is estimated that it usually takes relatively long time until the potential fluctuation becomes a fluctuation amount which is large enough to invert the memory state.

Accordingly, the potential of the output node N8' has its object to supplement or complement a change amount of charge derived from the relatively slow fluctuation and hence, even when the resistor RFB having high resistance is inserted into the above-mentioned portion, such an object can be achieved.

Due to such a constitution of the embodiment, even when the capacity of the node N9 is relatively large mentioned in the above-mentioned step (14) and hence, the state of the transistors PLTR1 and the transistor NLTR1 which constitute the second inverter are temporarily controlled by the node N9 and the output of the node N9 becomes an undesirable potential, the setting is performed in the state that these transistors are controlled by the node N8 in the sequence mentioned in the above-mentioned steps (6), (11) before the potential changes the state of the node N8 through the resistor RFB whereby the memory data is held more assuredly.

FIG. 5 is a circuit diagram for explaining the constitution of one pixel of the third embodiment of the invention. Symbols which are equal to the symbols in FIG. 4 indicate the same functional portions. In this embodiment, between an input node N8 of a p-type field effect transistor PLTR2 and an n-type field effect transistor NLTR2 which constitute a second inverter and an output node N8' of a p-type field effect transistor PLTF1 and an n-type field effect transistor NLTF1 which constitute a first inverter, an NMOS transistor NFBSW is inserted. A gate input node of the NMOS transistor NFBSW is connected to the alternating voltage line PBP.

According to the constitution of this embodiment, only when a transistor PLTR2, a transistor NLTR2 and a transistor PLTF2 and a transistor NLTF2 which constitute two inverters (the second inverter and the first inverter) are in the bias state, that is, only when the p-type side voltage is higher than the n-type side voltage, the NMOS transistor NFBSW becomes the "ON" state. Accordingly, in the states of the above-mentioned steps (6) and (11), the electrical connection between the output node N8' of the transistor PLTR2 and the transistor NLTR2 which constitute the second inverter and the input node N8' of the transistor PLTF2 and the transistor NLTF2 which constitute the first inverter is cut. Accordingly, the situation mentioned in the above-mentioned step (14) does not occur.

FIG. 6 is a circuit diagram for explaining the constitution of one pixel of the fourth embodiment of the invention. Symbols which are equal to the symbols in FIG. 6 indicate functional portions identical with those in FIG. 5. In this embodiment, between an output node N8' of a p-type field effect transistor PLTR2 and an n-type field effect transistor NLTR2 which constitute a second inverter and an input node N8 of a p-type field effect transistor PLTF1 and an n-type field effect transistor NLTF2 which constitute a first inverter, an NMOS transistor PFBSW is inserted. A gate input node of the NMOS transistor PFBSW is connected to the alternating voltage line PBN.

Also due to the constitution of this embodiment, advantageous effects similar to those explained in view of FIG. 5 can be obtained.

In the constitutions explained in the above-mentioned respective embodiments, since the CMOS transistor is used not only in the discharge mode but also in the charge mode, it is necessary to perform designing taking the threshold value voltage drop of the transmission voltage in the charge mode into account. For example, when the alternating voltage line PBN and the pixel electrode are electrically connected with the transistor NPVS2 which constitutes the third inverter in the "ON" state, although the "Low" voltage of the alternating voltage line PBN is directly transmitted, the "High" voltage becomes a voltage which is dropped by a threshold value amount.

For example, when the threshold value is set to VthN, it is necessary to take it into the consideration that the fixed voltage VCOM is set in the vicinity of {(High(+V)+Low−(−V)/2)−VthN/2.

In the circuit constitution shown in FIG. 2, when the output impedance of the second inverter (transistors PLTR1 and NLTR1) is extremely low, there is a possibility that even when the writing is performed after the transistors VADSW1 and HADSW1 become the "ON" state, the previous state is preserved. In such a case, it is effective to make the circuit have the constitution shown in FIG. 4.

In the above-mentioned respective embodiments, as the MOS transistor of the signal input part, the case which uses two transistors VADSW1 and HADSW1 for XY address in the pixel portion is explained. However, one of these transistors, for example, as used usually, the MOS transistor HADSW1 for X address may be arranged at a portion not shown in the drawing as a switch for selecting the video signal line (drain line) DL. Further, the arrangement of the MOS transistors VADSW1 and HADSW1 may be set in an arrangement opposite to the arrangement shown in the drawing.

Subsequently, other embodiments of the invention are explained in conjunction with FIG. 7 to FIG. 12. In performing the multiple gray scale display by a dither using pixels having the memory function, signal lines corresponding to the number of gray scales become necessary. Accordingly, it is difficult to obtain the high definition.

To solve such a problem, according to the invention, using memory-incorporated pixels, (1) one pixel is constituted of a plurality of cells (sub-cells made of liquid crystal cells, electroluminescence element or the like) which differ in cell size, (2) four gray scales are displayed with two signal lines, (3) eight gray scales are displayed with three signal lines, (4) gray scales are displayed by a dither, and (5) gray scales are displayed with FRC (Frame Rate Control).

Figure 7:
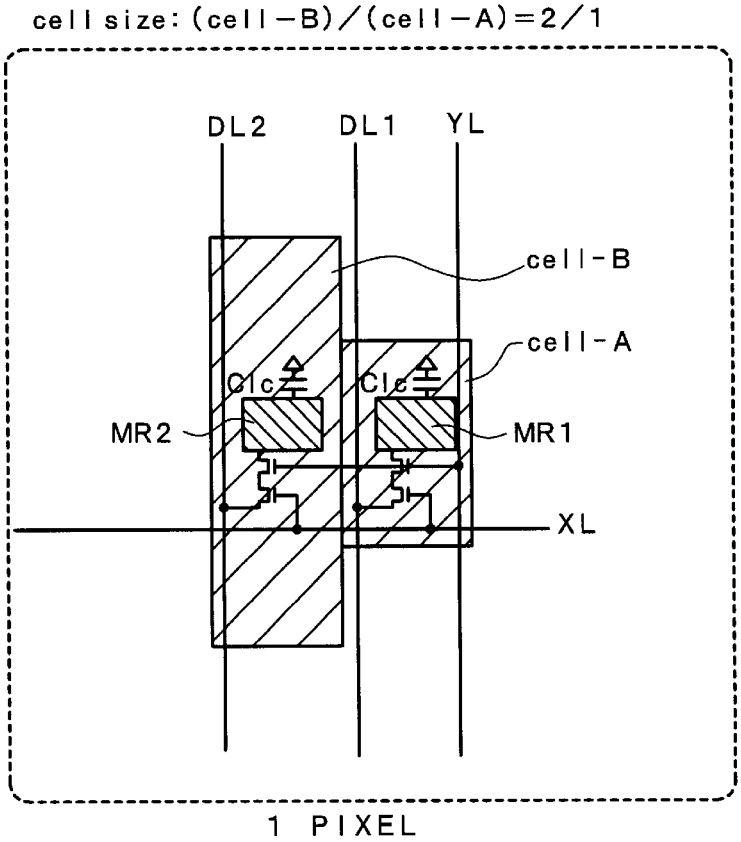
FIG. 7 is an explanatory view of a constitution of a pixel which performs a four gray scale display.

FIG. 7 is an explanatory view of the pixel constitution which performs the four gray scale display. In this embodiment, one pixel is constituted of two cells (cell A: cell-A and cell B: cell-B) and these cells respectively have memories MR1, MR2.

XL and YL are selection lines. XL indicates an address line in the lateral (horizontal) direction, YL indicates an address line in the longitudinal (vertical) direction, DL1 indicates a data line (a drain line or a video signal line) of the cell A, and DL2 indicates a data line of the cell B. CLC indicates a liquid crystal capacity.

One pixel is constituted such that the cell size is set to (cell B: cell-B/cell A: cell-A)=2/1. The cell A: cell-A and the cell B: cell-B are respectively provided with 1 bit memories MR1, MR2.

Respective one bit memories MR1, MR2 have binary values "1" and "0". The address lines XL, YL perform the designation of the address of the pixel in which the display data is written. The data lines DL1 and DL2 input display data of each cell.

The pixel selected by the address lines XL and YL takes in the display data through the data lines DL1 and DL2 and stores them in the memories MR1, MR2 of respective cells. The stored data is held until it is rewritten next time.

Figure 8:
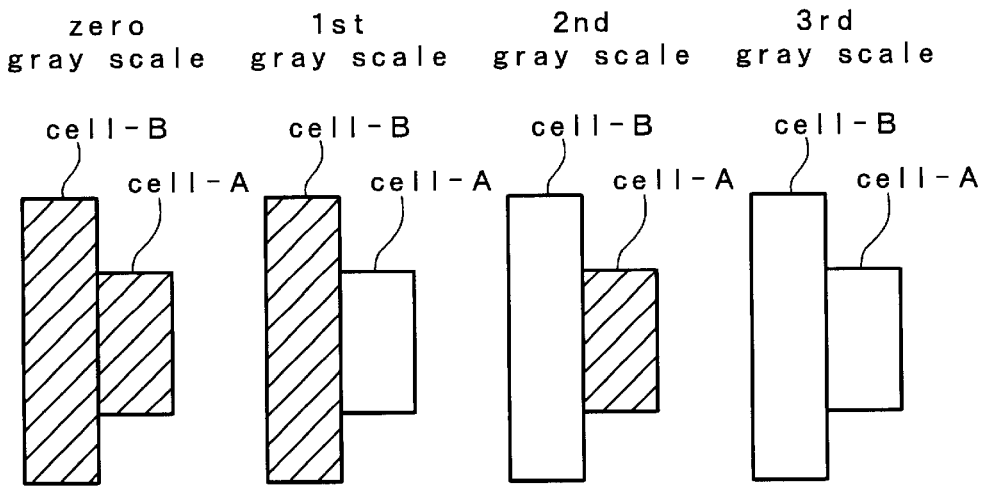
FIG. 8 is an explanatory view of the display state of a cell for a four gray scale display.
Figure 9:
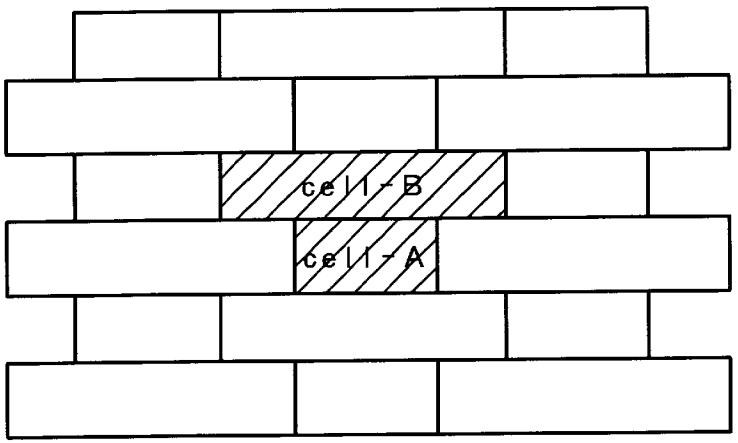
FIG. 9 is a constitutional view of a matrix for the four gray scale display.

FIG. 8 is an explanatory view of the display state of cells in four gray scale display. In the drawing, a white painted-out portion indicates a selected cell and a hatched portion indicates a non-selected cell. Further, FIG. 9 is a constitutional drawing of a matrix of the four gray scale display. The pixel constituted of two cells, that is, the cell A: cell-A and the cell B: cell-B performs four gray scale displays from a zero gray scale display to a third gray scale display.

In the zero gray scale display, the cell A: cell-A and the cell B: cell-B are both set to "0". In the first gray scale display, the cell A: cell-A is set to "1" and the cell B: cell-B is set to "0". In the second gray scale display, the cell A: cell-A is set to "0" and the cell B: cell-B is set to "1". In the third gray scale display, the cell A: cell-A and the cell B: cell-B are both set to "1". Assuming that the area of the cell A: cell-A is 1S, the area of the cell B: cell-B becomes 2S which is twice as large as the area of the cell A: cell-A.

To take the state in which a voltage is applied to the liquid crystal when the display data of the cell is "1" as an example, the voltage areas in respective gray scale displays become such that the voltage area is zero in the zero gray scale display, 1S in the first gray scale display, 2S in the second gray scale display and 3S in the third gray scale display.

In this embodiment, the high definition display using the pixels having memory functions can be realized.

Figure 10:
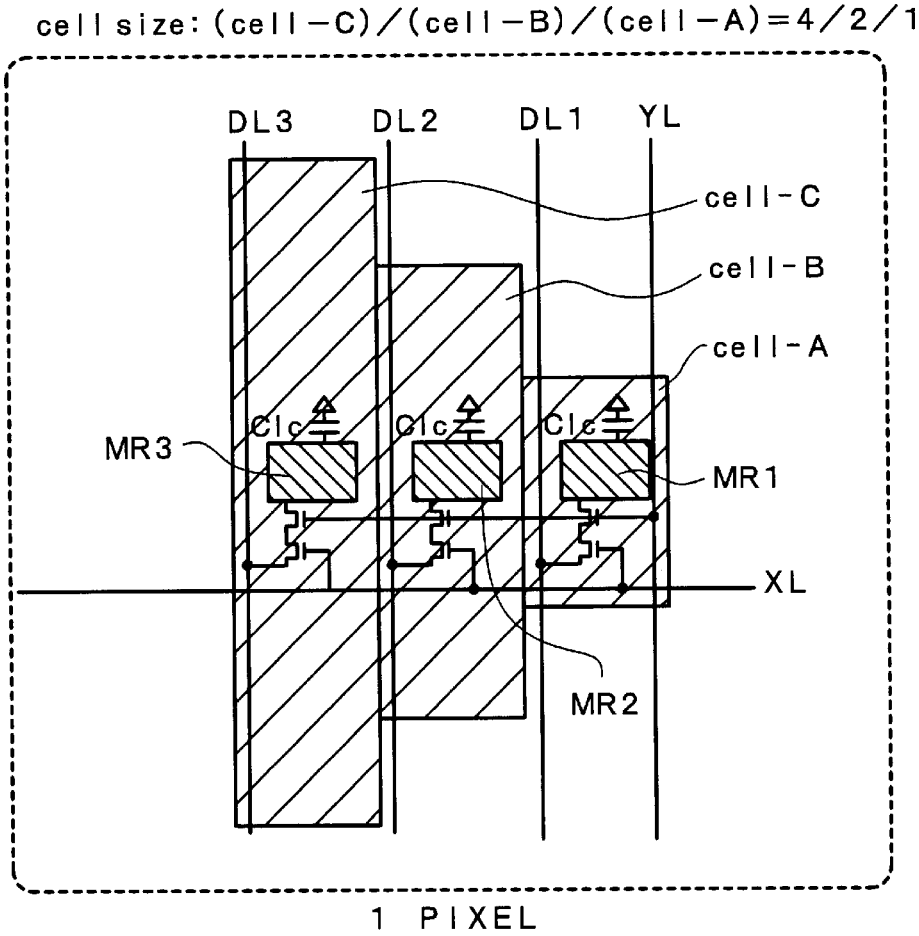
FIG. 10 is an explanatory view of a constitution of a pixel which performs an eight gray scale display.

FIG. 10 is an explanatory view of the pixel constitution which performs the eight gray scale display. In this embodiment, one pixel is constituted of three cells (cell A: cell-A, cell B: cell-B and cell C: cell-C) and these cells respectively have memories MR1, MR2 and MR3.

XL and YL are selection lines. XL indicates an address line in the lateral (horizontal) direction, YL indicates an address line in the longitudinal (vertical) direction, DL1 indicates a data line (a drain line or a video signal line) of the cell A, DL2 indicates a data line of the cell B and DL3 indicates a data line of the cell C. CLC indicates a liquid crystal capacity.

One pixel is constituted such that the cell size is set to (cell C: cell-C/cell B: cell-B/cell A: cell-A)=3/2/1. The cell A: cell-A, the cell B: cell-B and the cell C: cell-C are respectively provided with 1 bit memories MR1, MR2, MR3.

Respective one bit memories MR1, MR2, MR3 have binary values "1" and "0". The address lines XL, YL perform the designation of the address of the pixel in which the display data is written. The data lines DL1, DL2 and DL3 input display data of each cell.

The pixel selected by the address lines XL and YL takes in the display data through the data lines DL1, DL2 and DL3 and stores them in the memories MR1, MR2 and MR3 of respective cells. The stored data is held until it is rewritten next time.

Figure 11:
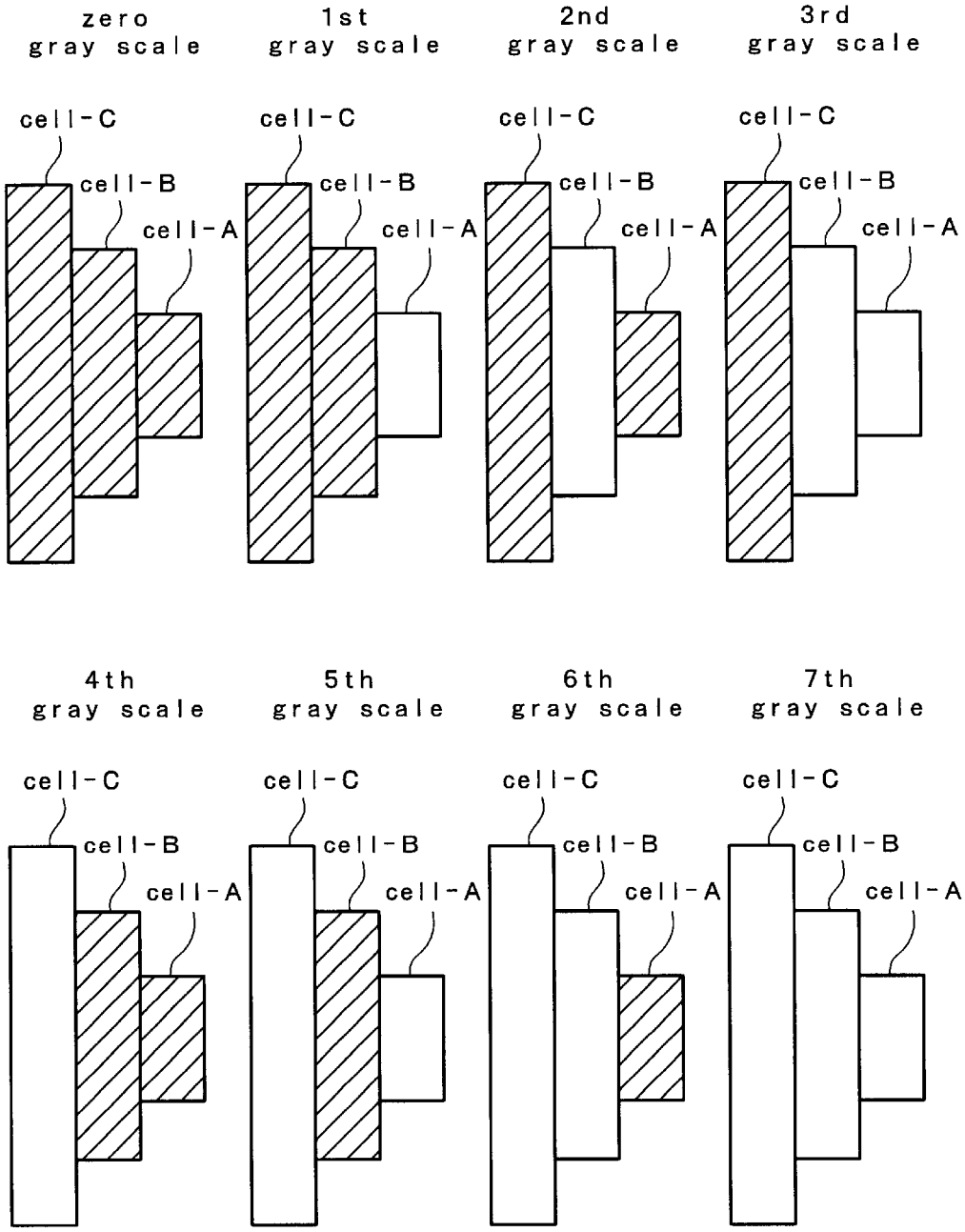
FIG. 11 is an explanatory view of the display state of a cell for the eight gray scale display.
Figure 12:
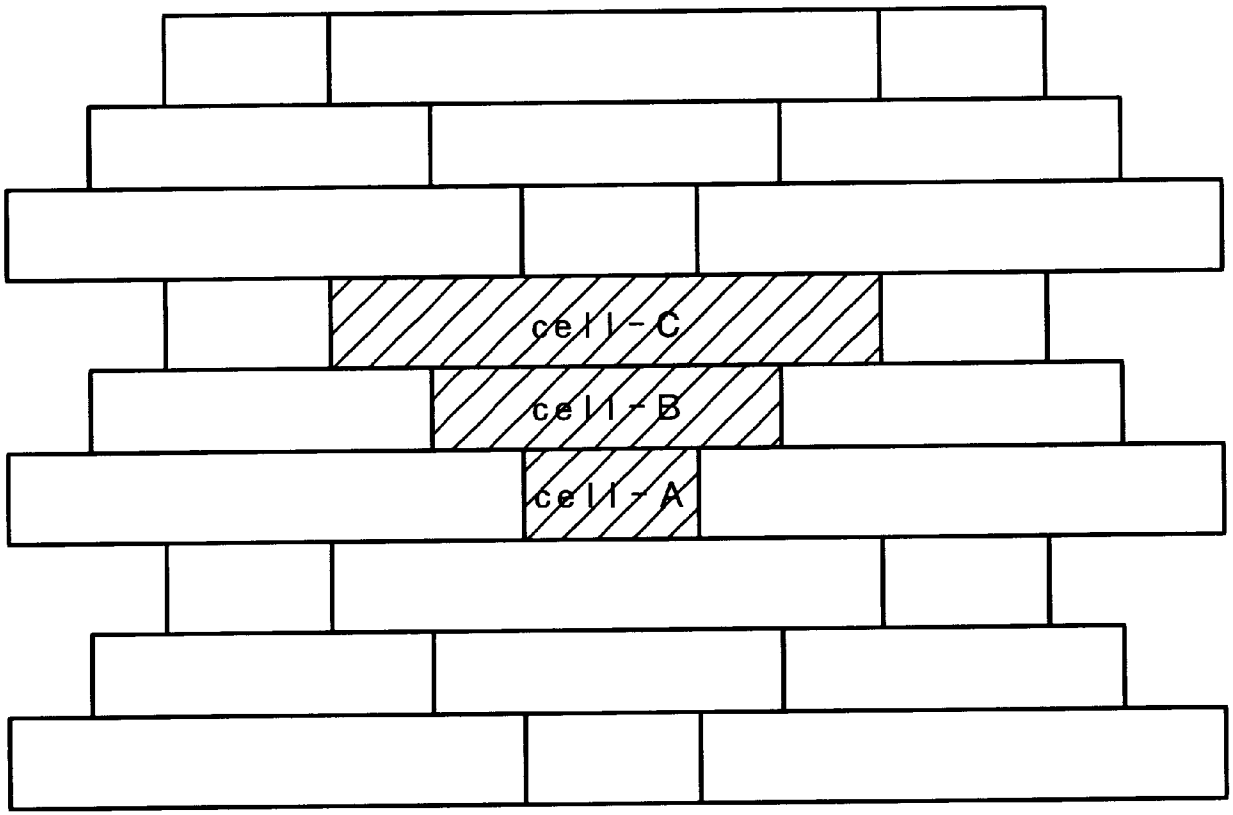
FIG. 12 is a constitutional view of a matrix for the eight gray scale display.

FIG. 11 is an explanatory view of the display state of cells in an eight gray scale display. In the drawing, a white painted-out portion indicates a selected cell and a hatched portion indicates a non-selected cell. Further, FIG. 12 is a constitutional drawing of a matrix of the eight gray scale display. The pixel constituted of three cells, that is, the cell A: cell-A, the cell B: cell-B and the cell C: cell-C performs eight gray scale displays from a zero gray scale display to a seventh gray scale display.

In the zero gray scale display, the cell A: cell-A, the cell B: cell-B and the cell C: cell-C are all set to "". In the first gray scale display, the cell A: cell-A is set to "1" and the cell B: cell-B and the cell C: cell-C are set to "0". In the second gray scale display, the cell A: cell-A is set to "0", the cell B: cell-B is set to "1" and the cell C: cell-C is set to "0".

In the third gray scale display, the cell A: cell-A and the cell B: cell-B are both set to "1" and the cell-C: cell-C is set to "0". In the fourth gray scale display, the cell A: cell-A and the cell B: cell-B are both set to "0" and the cell C: cell-C is set to "1". In the fifth gray scale display, the cell A: cell-A is set to "1", the cell B: cell-B is set to "0" and the cell C: cell-C is set to "1". In the sixth gray scale display, the cell A: cell-A is set to "0", the cell B: cell-B is set to "1" and the cell C: cell-C is set to "1". In the seventh gray scale display, the cell A: cell-A, the cell B: cell-B and the cell C: cell-C are all set to "1".

Assuming that the area of the cell A: cell-A is 1S, the area of the cell B: cell-B becomes 2S which is twice as large as the area of the cell A: cell-A and the area of the cell C: cell-C becomes 3S which is three times as large as the area of the cell A: cell-A.

To take the state in which a voltage is applied to the liquid crystal when the display data of the cell is "1" as an example, the voltage areas in respective gray scale displays become such that the voltage area is zero in the zero gray scale display, 1S in the first gray scale display, 2S in the second gray scale display, 3S in the third gray scale display, 4S in the fourth gray scale display, 5S in the fifth gray scale display, 6S in the sixth gray scale display and 7S in the seventh gray scale display.

Also in this embodiment, the high definition display using the pixels having the above-mentioned memory functions can be realized.

Here, the number of cells which constitute one pixel is not limited to 2 or 3 and. That is, one pixel can be constituted of a large number of cells.

In the multiple gray scale display explained in the above-mentioned respective embodiments, it is unnecessary to provide signal lines in number corresponding to the number of gray scales and hence, the number of wiring can be largely decreased compared with the display with the usual dither.

Further, by adopting an FRC method in place of the dither display in FIG. 7 and FIG. 10, the similar advantageous effect can be obtained. In the circuit constitution which adopts the FRC, intermediate gray scales are displayed by controlling the rate between the cell turn-on time and the cell turn-off time in FIG. 7 and FIG. 10 using peripheral drive circuits (x drive circuits RAX, SEL and Y drive circuit RAY).

In the invention, by performing the gray scale display using the FRC method, the multiple gray scale display can be performed with the number of wiring smaller than that of dither display. When the gray scale display is performed using the FRC method, because of the gray scale display, the FRC method can not cope with the rapid display. Accordingly, when the moving image is to be displayed, the dither display is superior to the FRC method.

Further, in the invention, by performing the gray scale display using both of the dither display and the FRC method, the number of gray scales can be further increased in the still image and it becomes possible to produce a sufficient number of gray scales even in the moving image.

In this manner, according to the constitution for the multiple gray scale display using a plurality of cells, the constitution uses two signal lines per one pixel in the fourth gray scale display, three signal lines per one pixel in the eighth gray scale display, . . . , that is, the signal lines of $n^2$ per one pixel in the nth gray scale display. That is, it can be constituted of signal lines in number equal to the bit number of the digital data.

Figure 13:
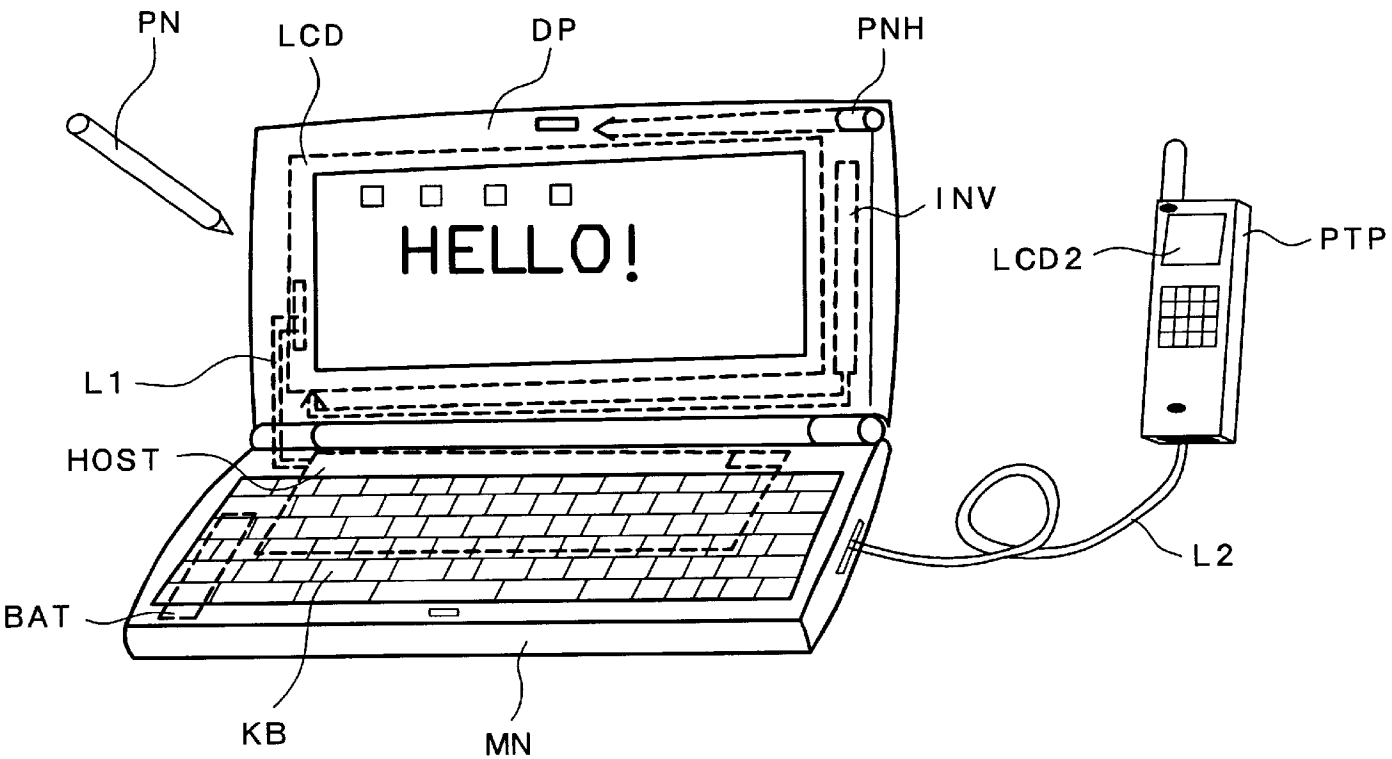
FIG. 13 is a perspective view for explaining an example of constitution of a portable information terminal as an example of an electronic appliance which mounts a liquid crystal display device according to the invention.
Figure 14:
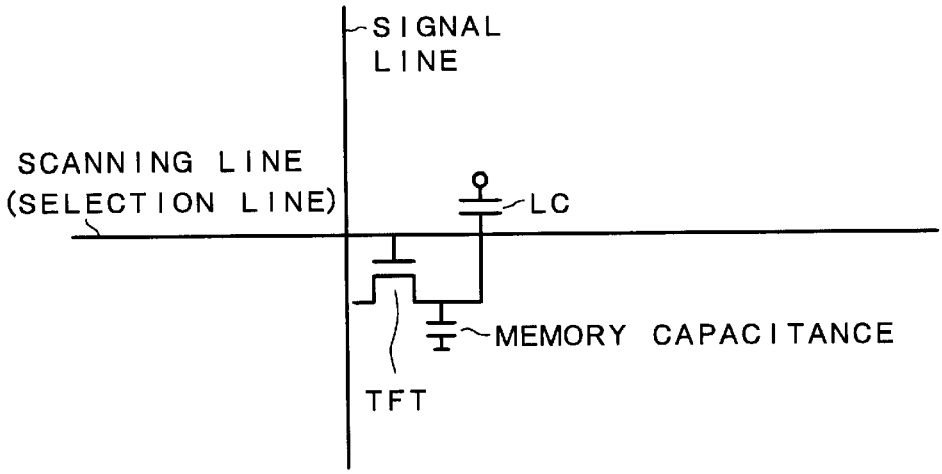
FIG. 14 is an explanatory view of an example of constitution of one pixel of a liquid crystal display device making pixels have memory functions.
Figure 15:
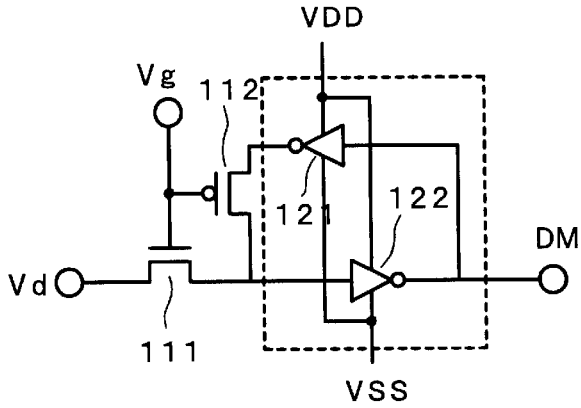
FIG. 15 is an essential part circuit block diagram for explaining an example of a memory circuit of static memory type.
Figure 16:
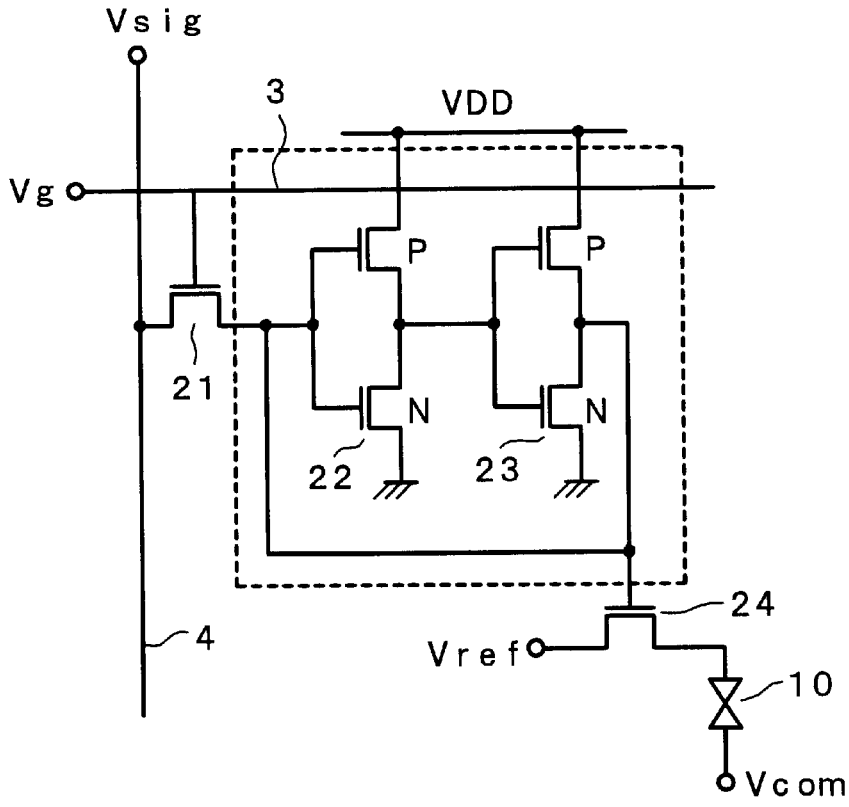
FIG. 16 is an essential part circuit block diagram for explaining other example of the memory circuit of static memory type.

FIG. 13 is a perspective view for explaining a constitutional example of a portable information terminal as an example of an electronic appliance on which the active matrix type display device according to the invention is mounted. This portable information terminal (PDA) is constituted of a main part MN which accommodates a host computer HOST and a battery BAT therein and is provided with a keyboard KB on a surface thereof and a display part DP which uses a liquid crystal display device LCD as a display device and mounts an inverter INV for backlight thereon.

A portable telephone set PTP can be connected to the main part MN through a connection cable L2 thus enabling the communication with a remote place.

The liquid crystal display device LCD of the display part DP is connected with the host computer MN through an interface cable L1.

According to the invention, since the display device has the image storing function, as the data which the host computer MN transmits to the display device LCD, it is sufficient to transmit a portion which is different from the display of the previous time and when there is no change in the display, it is unnecessary to transmit data. Accordingly, the burden that the host computer MN has to bear becomes extremely light.

Accordingly, the information processing equipment using the display device of the invention can process the data at high speed with multiple function in spite of its miniaturized constitution.

Further, a pen holder PNH is provided to a portion of the display part DP and an input pen PN is accommodated in the pen holder PNH.

In this liquid crystal display device, various kinds of information are inputted through the inputting of information using the keyboard KB or through the push manipulation, tracing or filling in the surface of a touch panel using an input pen PN. Alternately, with such an inputting manipulation, it is possible to perform the selection of information, the selection of processing functions and various other manipulations displayed on a liquid crystal display element PNL.

The shape and structure of this type of portable information terminal (PDA) are not limited to those shown in the drawing and portable information terminals having various other shapes, structures and functions can be considered.

Further, with the use of the active matrix type display device of the invention as a display element LCD2 which is used in the display part of the portable telephone set PTP shown in FIG. 13, an information quantity of the display data transmitted to the display element LCD2 can be reduced and hence, image data which is transmitted through electric waves or a communication line can be reduced whereby the display of characters figures and photographs of multiple gray scales and high definition and further the moving image display can be performed in the display part of the portable telephone set.

It is needless to say that the liquid crystal display device of the invention can be applied not only to the portable information terminal explained in conjunction with FIG. 13 but also to a desktop type personal computer, a notebook type personal computer, a projection type liquid crystal display device and other monitor equipment of an information terminal.

Further, the active matrix type display device of the invention is not limited to a liquid crystal electroluminescence display device and is applicable to any matrix type display device such as a plasma display.

As has been explained heretofore, according to the invention, it becomes possible to provide the active matrix type display device which has an image memory circuit equivalent to a static memory circuit and can realize the image display of multiple gray scales with high numerical aperture and high definition and with a least number of wiring.

What is claimed is:

1. A liquid crystal display device including two substrates which face each other in an opposed manner with one of two substrates being transparent and a liquid crystal layer which is sandwiched between a pair of two substrates, wherein said liquid crystal display device includes a plurality of pixels which have a function of holding video signals until said video signals are selected and rewritten next time, a plurality of signal lines which apply video signals to a plurality of said pixels, signal line drive means for supplying video signals to said signal lines, a plurality of selection signal lines for selecting pixels to which said video signals are applied, and a plurality of alternating voltage lines which supply a pair of alternating voltages to one of electrodes which sandwich a liquid crystal such that a fixed voltage which is selected for each pixel in accordance with said video signals and two kinds of voltages which differ for each field are made different from each other, the liquid crystal display device includes a first inverter in which a function to hold said video signals which said pixels hold until said video signals are rewritten next time sets a potential of said video signals selected by said selection signal lines and written in the inside of said pixels as an input gate potential and to which electrodes or diffusion regions which constitute respective sources or drains of a pair of p-type and n-type field effect transistors are electrically connected, a pair of p-type and n-type field effect transistors which constitute a second inverter which is similar to said first inverter, said second inverter setting a potential of an output portion to which said electrodes or diffusion regions which constitute respective sources or drains of a pair of p-type and n-type field effect transistors of said first inverter as an input gate potential of said second inverter, and a pair of p-type and n-type field effect transistors constituting a third inverter similar to said first and second inverters, said third inverter setting an output of a pair of p-type, n-type field effect transistors which constitutes said second inverter as an input gate potential thereof, outputs of a pair of p-type and n-type field effect transistors which constitute said second inverter are simultaneously electrically connected to an input gate of said first inverter, electrodes or diffusion regions of n-type field effect transistors of said first and second inverters which form sources or drains which are not outputs of inverters are connected to one of an alternating voltage line which supplies a pair of said alternating voltages, electrodes or diffusion regions of p-type field effect transistors of said first and second inverters which form sources or drains which are not outputs of inverters are connected to an alternating voltage line which forms a pair with said alternating voltage line to which said electrodes or said diffusion regions of n-type field effect transistors of said first and second inverters which form sources or drains which are not outputs of inverters are connected, one of an electrode or a diffusion region of n-type field effect transistor of said third inverter which forms a source or a drain which is not an output of inverter is connected to either one of said alternating voltage lines and the other of said alternating voltage lines is connected to a fixed voltage.

2. A liquid crystal display device according to claim 1, wherein said outputs of a pair of p-type and n-type field effect transistors which constitute said second inverter are electrically connected with said input gate of said first inverter through a resistor.

3. A liquid crystal display device according to claim 1, wherein between said output of a pair of p-type and n-type field effect transistors which constitute said second inverter and said input gate of said first inverter, an n-type field effect transistor which has one of an electrode or a diffusion region thereof which constitutes a source or a drain electrically connected with said outputs of a pair of p-type and n-type field effect transistors which constitute said second inverter and the other of said electrode or said diffusion region connected to said input gate of said first inverter is provided, said gate electrode of said n-type field effect transistor is, when a voltage of said alternating voltage line to which said electrodes or said diffusion regions which form sources or a drains which are not inverter outputs of said p-type field effect transistors of said first and second inverters are connected is in a voltage stage having a higher absolute voltage out of two kinds of different voltages, connected to other alternating voltage line which is equal to or performs the same change as said alternating voltage line to which said electrode or said diffusion region which forms said source or said drain which are not inverter outputs of said p-type field effect transistors of said first and second inverters is connected such that said n-type field effect transistor is turned on.

4. A liquid crystal display device according to claim 1, wherein between said output of a pair of p-type and n-type field effect transistors which constitute said second inverter and said input gate of said first inverter, an n-type field effect transistor which has one of an electrode or a diffusion region thereof which constitutes a source or a drain electrically connected with said outputs of a pair of p-type and n-type field effect transistors which constitute said second inverter and the other of said electrode or said diffusion region connected to said input gate of said first inverter is provided, said gate electrode of said n-type field effect transistor is, when a voltage of said alternating voltage line to which said electrodes or said diffusion regions which form sources or drains which are not inverter outputs of said p-type field effect transistors of said first and second inverters are connected is in a voltage stage having a higher absolute voltage out of two kinds of different voltages, connected to an alternating voltage line which is different from said alternating voltage line to which said electrode or said diffusion region which forms said source or said drain which is not inverter outputs of said p-type field effect transistors of said first and second inverters is connected such that said n-type field effect transistor becomes the "ON" state.

5. A liquid crystal display device according to claim 1, wherein said fixed voltage is set to a voltage value between two different kinds of voltages of a plurality of said alternating voltage lines which supply a fixed voltage which differs every field and a pair of voltages which alternate such that two kinds of voltages which differ every field are made different from each other to one of electrodes which sandwiches said liquid crystal.

6. A liquid crystal display device according to claim 1, wherein said fixed voltage is set to an intermediate voltage value between two different kinds of voltages of a plurality of said alternating voltage lines which supply a fixed voltage which differs every field and a pair of voltages which alternate such that two kinds of voltages which differ every field are made different from each other to one of electrodes which sandwiches said liquid crystal.

7. A liquid crystal display device according to claim 1, wherein out of said electrodes or said diffusion regions which form respective sources or drains which are not inverter outputs of said p-type and n-type field effect transistors of said third inverter, said electrode or said diffusion region which forms said source or said drain which is not an inverter output of said p-type field effect transistor is connected to said alternating voltage line, said electrode or said diffusion region which forms said source or said drain which is not an inverter output of said n-type field effect transistor is connected to said fixed voltage, and the value of said fixed voltage is set higher than an intermediate voltage between two different kinds of voltages of a plurality of said alternating voltage lines which supply a fixed voltage which differs every field and a pair of voltages which alternate such that two kinds of voltages which differ every field are made different from each other to one of electrodes which sandwich said liquid crystal by ½ of a threshold value of said p-type field effect transistor of said third inverter.

8. A liquid crystal display device according to claim 1, wherein, out of said electrodes or said diffusion regions which form respective sources or drains which are not inverter outputs of said p-type and n-type field effect transistors of said third inverter, said electrode or said diffusion region which forms said source or said drain which is not an inverter output of said n-type field effect transistor is connected to said alternating voltage line, said electrode or said diffusion region which forms said source or said drain which is not an inverter output of said p-type field effect transistor is connected to said fixed voltage, and the value of said fixed voltage is set higher than an intermediate voltage between two different kinds of voltages of a plurality of said alternating voltage lines which supply a fixed voltage which differs every field and a pair of voltages which alternate such that two kinds of voltages which differ every field are made different from each other to one of electrodes which sandwich said liquid crystal by ½ of a threshold value of said n-type field effect transistor of said third inverter.

* * * * *